United States Patent [19]

Klann

[11] 4,151,774

[45] May 1, 1979

[54] ORGAN PEDAL BOARD

[76] Inventor: Paul A. Klann, Box 2398 - 301 Fourth St., Waynesboro, Va. 22980

[21] Appl. No.: 861,935

[22] Filed: Dec. 19, 1977

[51] Int. Cl.[2] ..... G10C 3/14

[52] U.S. Cl. ..... 84/1.01; 84/DIG. 25

[58] Field of Search ..... 84/72, 353, 357, 366, 84/426, 444, DIG. 7, DIG. 25, 423, 433–436, 1.01

[56] References Cited

U.S. PATENT DOCUMENTS

| | | | |
|---|---|---|---|
| 316,023 | 4/1885 | Ellis | 84/434 |
| 527,467 | 10/1894 | Trainer | 84/366 |
| 589,649 | 9/1897 | Dernell et al. | 84/426 |
| 2,848,920 | 8/1958 | Lester | 84/423 X |
| 3,617,600 | 11/1971 | Ohno | 84/1.1 |

*Primary Examiner*—Lawrence R. Franklin
*Attorney, Agent, or Firm*—Sughrue, Rothwell, Mion, Zinn and Macpeak

[57] ABSTRACT

The organ pedal board includes a plurality of keys each having a magnet adjustably mounted on one end thereof for actuating the reed switch. Each reed switch is disposed at an angle of 45° relative to the vertical plane of movement of each key with the upper most end of each reed switch being disposed adjacent to but below the magnet when the key is in rest position. Each magnet is comprised of an oblong piece of rubber or plastic ferrite material secured to the head end of a screw which is threaded into the end of a key for rotatable and longitudinal adjustment of the magnet relative to the longitudinal axis of the key. The opposite end of each key is secured to a supporting block by means of a thin flexible strip with the end of the key slightly overlapping and resting on the supporting block for pivotal movement about the edge thereof. One or more hollow elastomeric tubes are secured to the frame of the pedal board and extend transversely of the pedals to provide cushioned limit stops for the pedals.

7 Claims, 5 Drawing Figures

FIG. 1
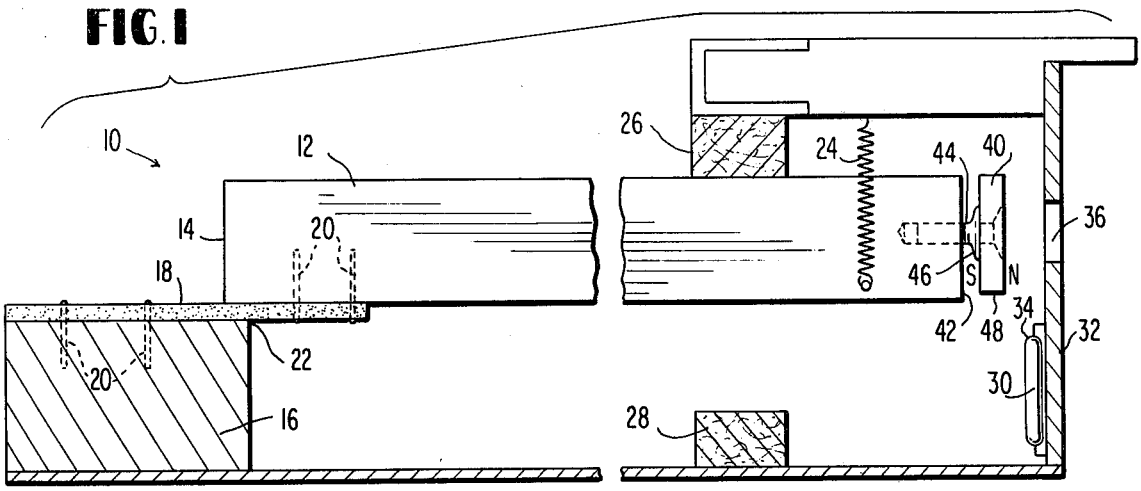
FIG. 2
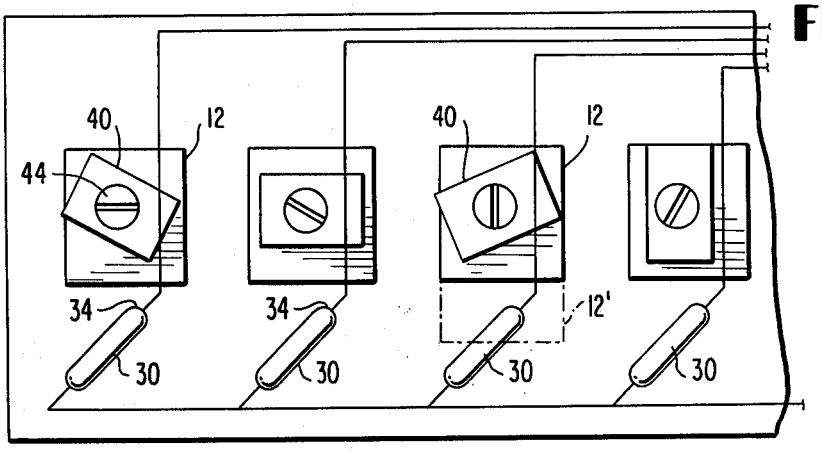
FIG. 3
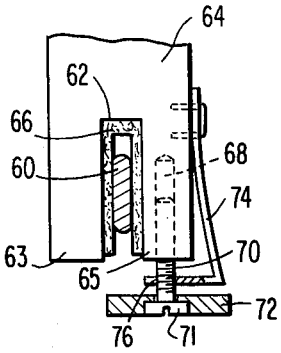
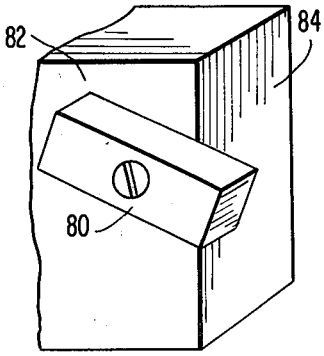
FIG. 4
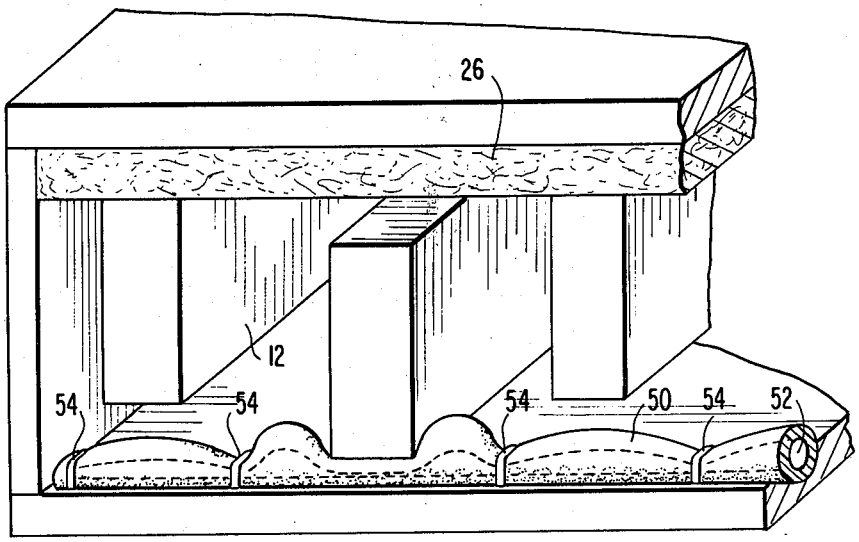
FIG. 5

ORGAN PEDAL BOARD

BACKGROUND OF THE INVENTION

1. Field of the Invention

The present invention is directed to organ pedal boards and more specifically to an improved mounting arrangement for each pedal key and a new and improved switching arrangement associated with each key.

2. Prior Art

In most prior art pedal boards the individual keys are mounted for pivotal movement on the supporting frame by means of a relatively stiff spring steel member which is secured to each pedal key and the support with a knife edge fulcrum engaging the spring steel member intermediate the ends thereof. Ordinarily felt strips are utilized to cushion the engagement of each pedal key with the frame at its limits of movement.

In most prior art pedal board arrangements having a magnetic reed switch associated with the end of each key upon which a magnet is mounted, the magnet is ordinarily disposed in the rest position intermediate the ends of the vertically disposed reed switch so that the switch will be disposed in the open position. Upon depression of the pedal key, the magnet will be moved downwardly adjacent one end of the reed switch thereby closing the switch. As the felt strip against which the pedals rest in their inactive position is compressed due to repeated contact by the keys the inactive position of the key may shift sufficiently to bring the magnet adjacent the upper most end of the reed switch thereby causing inadvertent closing of the magnetic switch. Furthermore, while it is desirable to have the magnets disposed as close as possible to the reed switches, this is a difficult objective since it is virtually impossible to form the wooden pedal keys, secure the magnet to the end thereof and secure each pedal key to the supporting block with uniform tolerances.

SUMMARY OF THE INVENTION

The present invention provides an organ pedal board wherein a new and improved mounting arrangement and magnetically operated switching arrangement completely eliminate the problem of uniform tolerances in the manufacture and mounting of individual keys in the pedal board. The pivotal mounting of each key in the pedal board is simplified by having the end of the key rest directly on the supporting block so that the forces applied to each key are transmitted directly to the supporting block. Each key is located in the proper position on the supporting block by means of a thin flexible strip which may be quickly and easily secured to the underside of the key and the upper surface of the supporting block by means of staples or any other quick, easy and inexpensive securing means.

The present invention provides a new and unique cushioning arrangement which does not compact from repeated engagement and which provides a soft, quiet and uniform stopping action for the key over long periods of use. Each cushioning member is comprised of an elongated piece of hollow elastomeric tubing which is secured to the supporting frame of the pedal board and which extends transversely to the keys for engagement thereby. The tubing may be pinched intermediate each key to substantially seal off discrete sections of the hollow tube to enhance the cushioning effect by means of the trapped air. Bleed holes between adjacent sections or bleed holes from each section to the atmosphere may be provided to provide for a limited flow of air to and from each section.

The present invention provides a new and unique magnetically operated switching arrangement for an organ pedal board wherein each magnet is comprised of an oblong piece of rubber or plastic ferrite material which is secured to the head end of a screw which, in turn, is threaded into the end of the key to provide for the rotational and longitudinal adjustment of the magnet relative to the longitudinal axis of the key. The magnetic switch for each key is mounted adjacent to but below each magnet and axially offset from each magnet relative to the longitudinal axis of each key. Each magnetic reed switch is disposed at a 45° angle relative to the vertical plane of movement of its associated key with the upper most end being in vertical alignment with the magnet mounting screw so that downward movement of the magnet upon depression of the pedal will bring the magnet into close proximity with the upper most end of the reed switch to close the switch without inadvertently operating adjacent switches. By rotating the screw upon which the magnet is mounted, the vertical plane of the magnet may be moved toward and away from the vertical plane of the reed switch and the lower most edge of the magnet may be adjusted relative to the upper most end of the reed switch to accurately determine the degree of movement of the pedal required to actuate the switch.

BRIEF DESCRIPTION OF THE DRAWINGS

FIG. 1 is a schematic transverse sectional view of an organ pedal board according to the present invention;

FIG. 2 is a schematic view showing the relationship of the magnets on the end of the pedal keys relative to the reed switches;

FIG. 3 is a modified view of a screw mounted magnet;

FIG. 4 is a perspective view of a magnet secured to the side of a pedal key;

FIG. 5 is a partial view of a pedal board according to the present invention utilizing a hollow elastomeric tube as a cushion stop for a plurality of pedal keys.

DETAILED DESCRIPTION OF THE INVENTION

As stated above in the description of the prior art, most organ pedal boards utilizing magnet reed switches have a magnet rigidly secured to the end of each pedal key with the reed switch being vertically disposed in alignment with the end of the pedal key so that the magnetic influence of the magnet on the reed switch at opposite ends of the reed switch will be balanced and the switch will remain open. Thus, if the magnet is not centered with respect to the reed switch in the rest position an inadvertent actuation of the magnetic switch might occur. This problem is overcome by the arrangement shown in FIG. 1 of the present application.

According to FIG. 1 the pedalboard 10 is comprised of a plurality of pedal keys, one of which is shown at 12. The end 14 of each key 12 overlaps and rests upon a supporting block 16. A thin flexible strip 18 of plastic or any other suitable material is connected at opposite ends to the key 12 and the block 16 by staples 20 or any other quick, easy and inexpensive fastening means. The purpose of the strip 18 is primarily to locate the key 12 in a fixed position on the supporting block 16 and therefore the strip does not have to be resilient or extremely stiff and rugged. All of the forces transmitted to the key 12 will be transferred directly to the supporting block 16 due to the overlapping relation of the end 14 and upon application of foot pressure to the key 12, the key will pivot about the edge 22 of the block 16. A spring 24 is provided for normally maintaining the key 12 in the raised position as shown in FIG. 1 against a transversely extending felt strip 26. A second transversely extending felt stip 28 is provided beneath the key to provide a cushioned lower limit stop.

An oblong or substantially rectangular magnet 40 is secured to the end 42 of each key 12 by means of a screw 44. The magnet is of rubber or plastic ferrite material and is secured to the head of the screw which is preferably of brass so that the screw will not have any adverse affect on the magnetic field. The screw can ordinarily be threaded directly through the magnetic material and secured therein by means of a press type sheet metal fastener 46 of the conventional type. Thus, the magnet 40 will be held adjacent the head of the screw 44 at all times. A magnetically operated reed switch 30 is secured to the end plate 32 of the pedal board 10 in a downwardly offset location relative to the magnet 40 when the key 12 is disposed in the rest position as shown in FIG. 1. Since the magnet 40 has an oblong or substantially rectangular configuration, rotation of the screw 44 will result in the rotation of the magnet 40 to vary the spacing between the lower edge 48 of the magnet and the upper end 34 of the magnetically operable reed switch to ensure the nonactuation of the switch 30 when the key 12 is in the rest position and to determine the requisite degree of movement of the key 12 in order to actuate the switch 30. Furthermore, the rotation of the screw 44 will move the magnet 40 toward and away from the end 42 of the key 12 to adjust the spacing between the magnet 40 and the reed switch 30 in the axial direction of the key when the key is depressed. The lower stop 28 is positioned so that the magnetic field of the magnet 40 will only influence the upper end 34 of the reed switch 30. In order to provide for easy adjustability of the magnet 40, an aperture 36 is provided in the end plate 32 adjacent the end of each key in the rest position for the insertion of a screwdriver to engage the screw 44 and rotate the same.

The location of the magnets 30 in a downwardly offset position relative to the end of the key in rest position would require a pedalboard having a considerably greater height if the reed switches were disposed in the vertical position as in the prior art arrangement. While the disposition of the reed switches in a horizontal position would provide for a substantial height reduction in the pedalboard the ends of two adjacent magents would be very close to each other so that upon depression of a key to bring the magnet thereon into operable position relative to the end of one switch might inadvertently cause the actuation of the adjacent switch. In order to provide for some reduction in height of the pedalboard and still avoid the problem created by the horizontal disposition of the switches, the switches 30 according to the present invention are disposed at substantially a 45° angle relative to the vertical plane of movement of its associated key 12. The upper most end 34 of each switch is disposed in substantial vertical alignment with the magnet securing screw 44 so that the lower most end 38 of the adjacent switch will be out of range of the magnetic field of a magnet which is moved into operative engagement with the upper end 34 of a switch 30. The magnets 40 as shown in FIG. 2 are disposed at different angular positions to demonstrate the ability to vary the effective distance between the magnet and the switch in the rest position. The dotted line 12' in FIG. 2 represents the lower most or operative position of the key 12 when it is depressed to bring its magnet 40 into operative position relative to the associated switch 30. The end plate 32 may be a transparent printed circuit board so that no loose wiring is necessary for the switches 30.

As mentioned previously, the repeated engagement of the felt strips 26 and 28 by the keys 12 can result in their permanent deformation which would adversely affect the location of the magnets 40 and switches 30 relative to each other in the operative and inoperative positions. In order to overcome this problem a new and improved cushion stop comprised of an elongated hollow elastomeric tube 50 is shown in FIG. 5. While the keys 12 in FIG. 5 are shown engaging a tube 50 in their depressed position and a conventional felt strip 26 in the upper position, it is obvious that the elastomeric tube 50 could also be substituted for the upper felt strip 26. The elastomeric tube is preferably pinched so that the inner passage 52 will be completely or substantially closed off at spaced locations intermediate the keys 12. This can quickly and easily be accomplished by the use of staples 54 as shown in FIG. 5. Alternatively, the tube 50 could be pinched and heat sealed by these locations. While the discrete sections of the tube 50 between the staples 54 can be completely sealed from each other, it is also feasible to leave a small bleed hole between adjacent sections of the tube so that upon engagement of one section of the tube 50 by a key 12, the air will be bled in a controlled manner from one section to another. Subsequently, when the key is raised, the air can bleed back through the same aperture to allow for the return of the section of the tube 50 to its normal position. Likewise it is also possible to provide each section of the tube 50 with a bleed hole to the atmosphere. The use of the elastomeric tube 50 prevents the compacting which occurred with the felt strips and, therefore, the magnet on the end of each key will be more accurately positioned relative to its associated reed switch for a much longer time interval.

While the keys 12 are usually guided for vertical movement by guide pins (not shown) on opposite sides of each key sometimes the guide pin 60 for a key 64 is disposed in a vertical slot 62 having a felt lining 66. Due to the reduced thickness of the end portions 63 and 65 of the key 64 a wood screw might split the end portions. Therefore, as shown in FIG. 3 a hole 68 is drilled in the end of the portion 65 and a machine screw 70 having a hollow hex head is located in the hole 68 which is not threaded, A magnet 72 similar to magnet 40 is secured to the head 71 of the screw 70 for rotation therewith. A leaf spring 74 is secured at one end to the side of the key 64 and opposite end is provided with a notch 76 which engages the threaded portion of the screw 70 to provide a threaded engagement with the screw 70. Thus, upon rotation of the screw 70, the magnet will be moved toward or away from the end of the key and the frictional fit of the screw 70 in the hole 68 due to the lateral bias of the spring 74 will maintain the adjusted position of the magnet.

An alternate location for a screw mounted magnet 80 is shown in FIG. 4 where the magnet 80 is rotatably secured to the vertical side 82 of the key 84. Thus, upon rotation of the magnet, the location of the end of the magnet may be raised relative to the related magnetic switch. Likewise, it would also be possible to locate the magnet on the top side or bottom side of the key.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. An organ pedal board comprising a frame, a plurality of pedal keys horizontally disposed substantially parallel to each other and pivotally mounted at one end thereof in said frame, a magnet adjustably secured adjacent the opposite end of each key, each magnet being comprised of an oblong piece of ferrite material secured to the head of a screw threaded into said opposite end of a key for rotational and axial adjustment of said magnet relative to the end of a key, means normally biasing said keys to a raised position, and magnetically operable switch means mounted on said frame adjacent each of said magents but downwardly offset relative thereto so that upon depression of a key the magnet thereon will be moved closer to said switch means to actuate said switch means.

2. An organ pedal as set forth in claim 1, wherein said screw is of non-magnetic material.

3. An organ pedal board comprising a frame, a plurality of pedal keys horizontally disposed substantially parallel to each other and pivotally mounted at one end thereof in said frame, a magnet adjustably secured adjacent the opposite end of each key, means normally biasing said keys to a raised position, and magnetically operable switch means mounted on said frame adjacent each of said magnets but downwardly offset relative thereto, each of said switch means being comprised of a reed switch disposed at an angle of approximately 45° relative to the plane of vertical movement of the related key with the uppermost end of each reed switch being disposed in substantially vertical alignment with the magnet on said key for actuation of the switch upon depression of a key to bring the magnet thereon into close proximity with the uppermost end of said reed switch.

4. An organ pedal board as set forth in claim 3, wherein each of said reed switches are mounted on a common vertically disposed plate spaced from and extending transversely relative to said keys and aperture means in said plate in alignment with the magnet on the end of each key for the insertion of means to adjust the position of each magnet on the end of its respective key.

5. An organ pedal board comprising a frame, a plurality of pedal keys horizontally disposed substantially parallel to each other and pivotally mounted at one end thereof in said frame, a magnet adjustably secured adjacent the opposite end of each key, each magnet being comprised of an oblong piece of ferrite material secured to the head of a screw threaded into a lateral surface of said key adjacent the end thereof, means normally biasing said keys to a raised position, and magnetically operable switch means mounted on said frame adjacent each of said magnets but downwardly offset relative thereto so that upon depression of a key the magnet thereon will be moved closer to said switch means to actuate said switch means.

6. An organ pedal board comprising a frame, a plurality of pedal keys horizontally disposed substantially parallel to each other and pivotally mounted at one end thereof in said frame, a magnet adjustably secured adjacent the opposite end of each key, each magnet being comprised of an oblong piece of ferrite material secured to the head of a machine screw disposed in a smooth hole in said key adjacent the opposite end thereof, leaf spring means mounted on said key in threaded engagement with the threaded portion of said machine screw, means normally biasing said keys to a raised position, and magnetically operable switch means mounted on said frame adjacent each of said magnets but downwardly offset relative thereto so that upon depression of a key the magnet thereon will be moved closer to said switch means to actuate said switch means.

7. An organ pedal board comprising supporting means, a plurality of pedal keys horizontally disposed substantially parallel to each other with one end of each key overlapping and resting on said supporting means, a thin flexible strip secured at opposite ends to the upper surface of said supporting means and the lower surface of each key to locate each key relative to said supporting means for pivotal movement about an edge thereof, and cushion stop means extending transversely of said keys for engagement by said keys as said keys pivot on said supporting means, said cushion stop means comprising an elongated hollow elastomeric tube and means disposed on opposite sides of each of said pedal means for pinching off said tube into discrete substantially airtight pockets each of which is engageable by a key.

* * * * *